US010119373B2

(12) United States Patent
O'Leary et al.

(10) Patent No.: US 10,119,373 B2
(45) Date of Patent: Nov. 6, 2018

(54) CUTTING TOOL

(71) Applicant: Proserv UK Limited, Westhill (GB)

(72) Inventors: Adam James O'Leary, Aberdeen (GB); Mark Douglas Stephen, Aberdeen (GB); Richard James Taylor, Kendal (GB); Ross Richardson, Auchterarder (GB)

(73) Assignee: PROSERV UK LIMITED, Aberdeenshire (GB)

( * ) Notice: Subject to any disclaimer, the term of this patent is extended or adjusted under 35 U.S.C. 154(b) by 221 days.

(21) Appl. No.: 14/717,518

(22) Filed: May 20, 2015

(65) Prior Publication Data

US 2015/0337634 A1 Nov. 26, 2015

(30) Foreign Application Priority Data

May 21, 2014 (GB) ..... 1409046.8

(51) Int. Cl.
*E21B 29/00* (2006.01)
*E21B 23/01* (2006.01)
*E21B 43/114* (2006.01)

(52) U.S. Cl.
CPC ..... *E21B 43/114* (2013.01); *E21B 23/01* (2013.01); *E21B 29/002* (2013.01)

(58) Field of Classification Search
CPC ..... E21B 43/114; E21B 29/00; E21B 29/02; E21B 29/06; E21B 31/16; E21B 29/002
See application file for complete search history.

(56) References Cited

U.S. PATENT DOCUMENTS

| | | | | |
|---|---|---|---|---|
| 2,525,391 | A * | 10/1950 | Bates | E21B 29/00 166/223 |
| 3,004,614 | A | 10/1961 | Janson et al. | |
| 5,381,631 | A | 1/1995 | Raghavan et al. | |
| 2001/0050172 | A1* | 12/2001 | Tolman | E21B 17/203 166/297 |
| 2005/0263282 | A1 | 12/2005 | Jeffrey et al. | |
| 2007/0187086 | A1 | 8/2007 | Ivanov et al. | |
| 2011/0079435 | A1 | 4/2011 | Drenth et al. | |

FOREIGN PATENT DOCUMENTS

| | | |
|---|---|---|
| EP | 0461819 A2 | 12/1991 |
| GB | 2354726 A | 4/2001 |
| GB | 2463849 B | 7/2011 |

OTHER PUBLICATIONS

Campbell et al., "Permanent Well Abandonment", vol. 9, No. 3, pp. 25-27 (Aug. 29, 2013).

* cited by examiner

*Primary Examiner* — Brad Harcourt
(74) *Attorney, Agent, or Firm* — Drinker Biddle & Reath LLP

(57) ABSTRACT

A cutting tool adapted to be deployed into a well casing for cutting through casing strings comprises a nozzle for directing a jet of an abrasive slurry at the wall of a well casing to sever the well casing and a mechanical locking arranged provided above the nozzle, said locking arrangement comprises radially expandable means selectively engageable with an inner wall of the well casing within which the tool is deployed, to prevent axial and/or rotational movement of the tool in the well during cutting operations.

15 Claims, 4 Drawing Sheets

CUTTING TOOL

FIELD OF THE INVENTION

The present invention relates to a cutting tool and more particularly to a well severance or down hole cutting tool adapted to be deployed into a well casing for cutting through casing strings.

BACKGROUND

Wells, such as those used for oil and gas extraction, comprise a bore extending into the seabed or ground, and lined with an internal well casing preventing any fluid extracted from coming into contact with ground or sea water. A well casing comprises a series of tubes, known as internal casing strings, with the diameter of each successive string being smaller than the last as the depth of the well increases, enabling drilling of the bore in stages. Once a portion of the bore is drilled, the casing string is inserted into the bore, with the annular space between the casing and the inner surface of the bore being filled with cement to hold the casing in place. Since successive casing strings must be passed through those already in place, they necessarily have a smaller diameter than the preceding casing. Consequently the bore is lined with multiple casing strings.

Once a well reaches the end of its economic life it is decommissioned, with the well needing to be plugged and abandoned and the casing strings recovered. This is done by applying a permanent (or occasionally temporary) plug and cutting or severing the casing string. Cutting the string requires deploying a downhole cutting tool within the casing and cutting the casing, for example, using an abrasive slurry jet, and removing the tool once the string is cut. Multiple string cutting tools are typically concentric with the casing string, and lowered down from the surface to be held in position whilst cutting takes place. Examples of such tools are disclosed in GB2,354,726 and GB2,463,849, for example.

Existing tools use an inflatable packer as part of the tool, which is inflated at the deployment depth (the depth at which the string needs to be cut) to restrain the device creating a seal within a well casing and preventing axial movement of the tool away from the deployment depth. Pressurised air is pumped below the tool to enable "de-watering", evacuating water from the target region of the abrasive slurry jet for example, which ensures the quality of abrasive cutting. One issue is that the pressure below the tool creates an upwards acting force on the tool, which has been known to cause the tool to slip upon failure of the inflatable packer. This can cause issues either with the cutting operation or damage or potential loss of the tool itself (which may fall downwards or be expelled from the well).

There is therefore a need to be able to deploy and recover multiple string cutting tools safely, reliably and in such a manner that the likelihood of the tool becoming damaged or lost, or the cutting operation being affected detrimentally, is minimised.

SUMMARY OF THE INVENTION

The present invention aims to address these issues by providing a jetting cutting tool adapted to be deployed into a well casing for cutting through casing strings, the tool comprising a nozzle for directing a jet of an abrasive slurry at the wall of a well casing to sever the well casing and a mechanical locking arrangement provided above the nozzle, said locking arrangement comprising radially expandable means selectively engageable with an inner wall of the well casing within which the tool is deployed, to prevent axial and/or rotational movement of the device in the well during cutting operations.

The main advantage of such a cutting tool arrangement is that by relying on a mechanical engagement between the tool and the casing wall, the tool remains locked in position while a significant pressure is present below the tool, such that the tool is unable to move axially during cutting operations. In addition, the locking arrangement prevents the cutting tool from axial movement within a well casing, ensuring a consistent cutting procedure. The cutting tool is preferably adapted for use in well severance or downhole operations.

Preferably, the mechanical locking arrangement comprises an outer cylindrical cage and an inner mandrel, the inner mandrel being moveable axially relative to the cage between a locked and an unlocked position.

The inner mandrel may have a profiled outer surface. Preferably, outer surface of the inner mandrel has a plurality of tapered recesses. Preferably a is provided within and can run along each of the tapered recesses on the inner mandrel, and wherein the outer wall of the cage is provided with a plurality of apertures such that a ball is held within a recess by the cage. Advantageously, the diameter of the balls is greater than the diameter of the apertures. The balls are preferably moveable between being retained within the recesses and protruding through the apertures.

Advantageously, when the mechanical locking arrangement is in a locked position, the locking arrangement is radially expanded such that the inner mandrel forces the balls to protrude through the apertures and engage with the inner wall of the casing. In this situation, when the tool is in a vertical position, preferably the weight of the inner mandrel and associated tool mass defaults the locking arrangement into the unlocked position, such that the balls are retained within the recesses.

Preferably the cutting tool further comprises a sealing arrangement. More preferably, the locking arrangement is combined with a sealing arrangement. Advantageously the sealing arrangement may comprise an expandable packer element.

According to a further aspect of the present invention there is provided a method of cutting through well casing in a casing string comprising the steps of deploying a jetting cutting tool into the well casing to the required depth at which the cut is to be made, locking the tool against the inner wall of the well casing above a nozzle of the tool to prevent axial and/or rotational movement of the tool during the cutting operation, pumping an abrasive slurry through the jetting tool and rotating the nozzle of the jetting tool to force a high powered jet of slurry against the inner wall of the well casing such that the well casing is severed.

Preferably the tool is locked against the inner wall of the well casing by selectively radially expanding a portion of the tool above the nozzle against the inner wall of the well casing.

Preferably also a further step is provided of isolating a portion of the wellbore between the expanded portion of the tool and the nozzle. Advantageously the portion wellbore is isolated by pumping a high pressure air or an inert gas into the wellbore between a sealing device and the nozzle.

Advantageously the jetting tool is activated only when the absence of well fluids in the isolated area surrounding the nozzle is detected.

In some embodiments the method may further comprise the step of recovering one of more severed casing sections out of the well.

BRIEF DESCRIPTION OF THE DRAWINGS

The invention will now be described by way of example only, and with reference to the accompanying drawings, in which.

DETAILED DESCRIPTION OF THE PREFERRED EMBODIMENTS

Rather than using a separate means to ensure the positioning and stability of a downhole cutting tool during the cutting of multiple strings, the present invention takes the approach of locking the tool into position using elements provided as part of the tool itself. A cutting tool and particularly a well severance or downhole cutting tool is adapted to be deployed into a well casing for cutting through casing strings thereby severing the conductor. Unlike existing systems, the tool comprises a mechanical locking arrangement. Said locking arrangement comprises radially expandable means that are selectively engageable with an inner wall of the well casing within which the tool is deployed. This prevents both vertical and axial movement of the device in the well during cutting operations.

Figure 1:
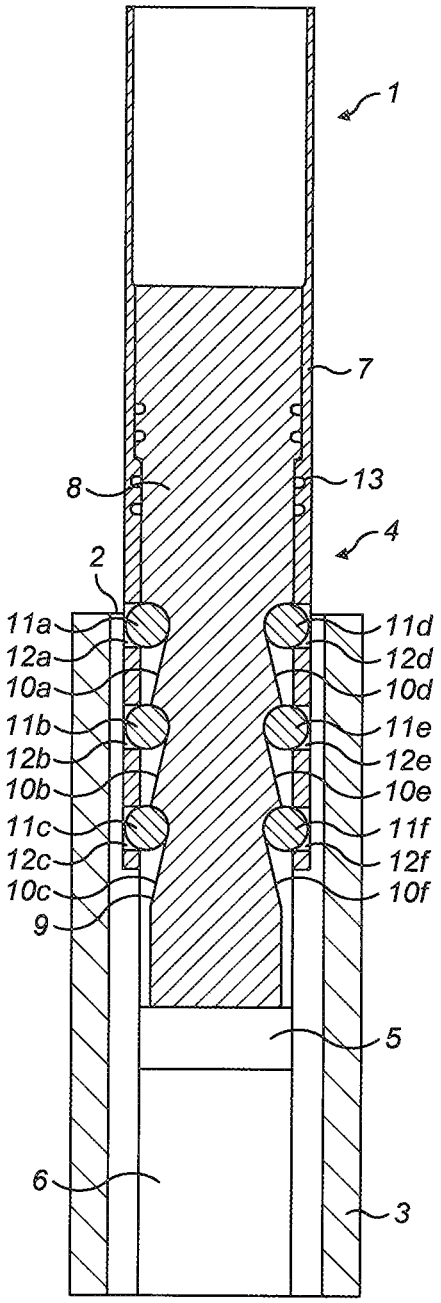
FIG. 1 is a schematic cross-section of a locking device of a cutting tool in accordance with an embodiment of the present invention in an unlocked position.

FIG. 1 is a schematic cross-section of a locking device of a cutting tool in accordance with an embodiment of the present invention in an unlocked position. The cutting tool 1 is shown at the entrance 2 of a well casing 3, and comprises a mechanical locking arrangement 4, a sealing arrangement 5 and a tool portion 6. The tool portion 6 is preferably part of a high pressure, abrasive water or slurry jet cutting system suitable for use during a well abandonment process. The tool portion 6 is provided below the mechanical locking arrangement 4 in use.

Figure 2:
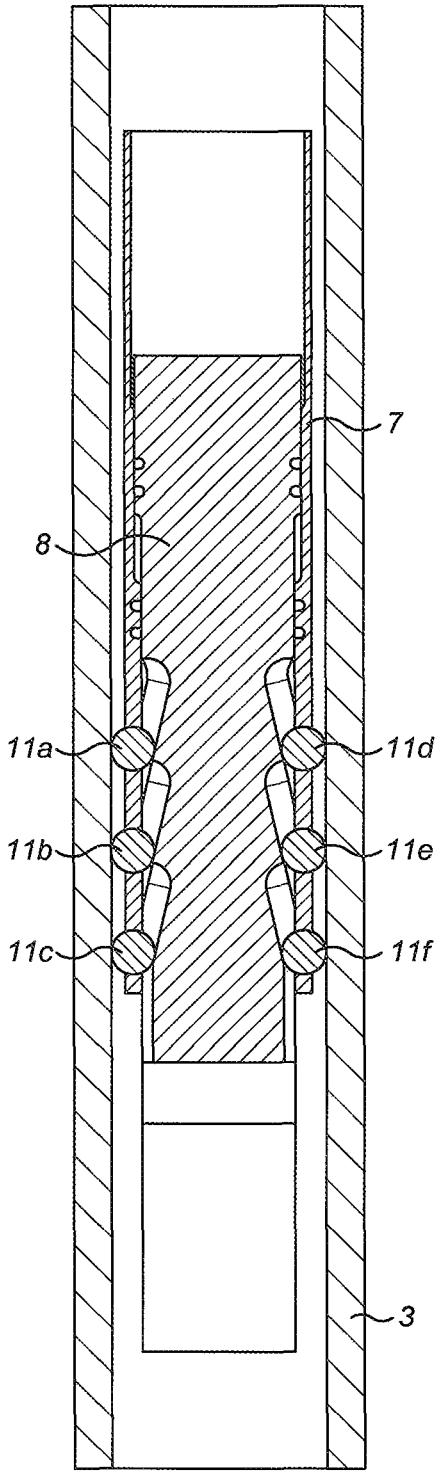
FIG. 2 is a schematic cross-section of the locking device of FIG. 1 in a locked position.

The cutting tool 1 is substantially cylindrical, and sized to fit co-axially within the well casing 3. The mechanical locking arrangement 4 comprises radially expanding means that are selectively engageable with an inner wall of the well casing 3. In this embodiment, the mechanical locking arrangement 4 comprises an outer cylindrical cage 7 and an inner mandrel 8, the inner mandrel 8 being moveable axially relative to the cage 7 between a locked (FIG. 2) and an unlocked (FIG. 1) position, described in more detail below. The outer cage 7 and inner mandrel 8 are substantially co-axial with one another.

The inner mandrel 8 has a profiled outer surface 9. In this embodiment, the outer surface 9 of the inner mandrel 8 has a plurality of tapered recesses 10*a-f*. A ball 11*a-f* is provided within each of the tapered recesses 10*a-f* of the inner mandrel 8. A portion of the cage 7 is provided with a plurality of apertures 12*a-f* such that a ball 11*a-f* is held within a recess 8*a-f* by the cage 7. The diameter D of the balls 11*a-f* is greater than the diameter d of the apertures 12*a-f*. This is to enable the balls 11*a-f* to protrude through the apertures 12*a-f* but not to pass through them completely, such that the cage 7 holds the balls 11*a-f* within the tapered recesses 10*a-f* of the inner mandrel 8 and prevents them from coming loose or falling out of the mechanical locking arrangements 4. A piston 13 is provided to actuate the central mandrel 8 to move between the unlocked position and the locked position. The piston 13 is driven by a lock supply pressure. When the downhole cutting tool 1 is in a vertical position, whilst in use within a casing string, the weight of the inner mandrel 8 and associated tool mass defaults the mechanical locking arrangement 4 into the unlocked position, such that the balls 11*a-f* are retained within the recesses 10*a-f*. In the unlocked position, the balls 11*a-f* are held at the deep end of the tapered recesses 10*a-f*, where they do not extend beyond the outer surface boundary of the cage and in the locked position the balls 11*a-f* are held at the shallow end of the tapered recessed 8*a-f* in which they protrude through the apertures 12*a-f* and extend beyond the outer surface boundary of the cage.

In order to activate the locking arrangement, the balls 11*a-f* are moveable between being retained within the cage 7 outer surface boundary and protruding through the apertures 12*a-f*. This is illustrated in more detail in FIG. 2, a schematic cross-section of the locking portion of a downhole cutting tool in accordance with an embodiment of the present invention in a locked position. Once the downhole cutting tool 1 is deployed in the correct position within the casing string 2, the piston 13 is actuated to move the inner mandrel 8 upwards, in the direction of arrows A and B. The apertures 12*a-f* of the cage 7 cause the balls 11*a-f* to move along the tapered recesses 10*a-f* from the deep end to the shallow end. This in turn causes the balls 11*a-f* to protrude from the apertures 12*a-f* in the cage 7, holding them firmly in position. Therefore when the inner mandrel 8 is in a locked position, the locking means 4 is radially expanded such that the balls 11*a-f* protrude through the apertures 12*a-f* and mechanically engage with the inner wall of the well casing 3. This is by means of an interference or friction fit between the balls 11 *a-f* and the inner wall of the well casing 3.

Figure 3:
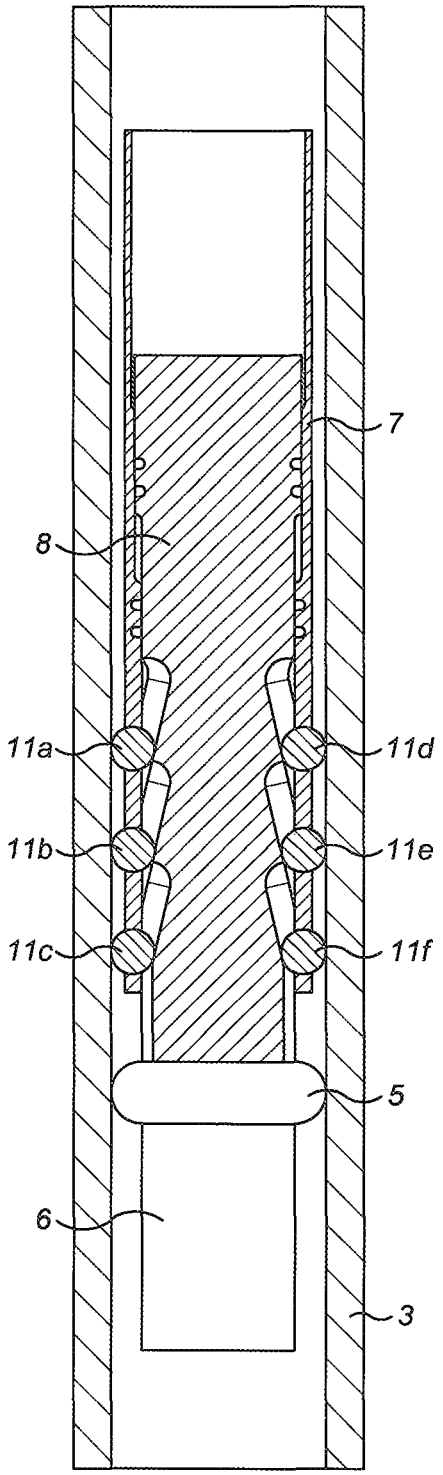
FIG. 3 is a schematic cross-section of the locking device of FIG. 1 in a locked position and with a seal engaged.

FIG. 3 is a schematic cross-section of a downhole cutting tool in accordance with an embodiment of the present invention in a locked position and with a seal engaged. Compared with FIG. 2, the sealing arrangement 5 is actuated, forming a seal between the downhole cutting tool 1 and the inner wall of the well casing 3. The sealing arrangement 5 may be integral with the locking mechanism 4 and/or the tool portion 6, or provided separately. Preferably the cutting tool 1 comprises a combined locking mechanism 4 and sealing arrangement 5, as shown in FIG. 3. In use, the lock supply pressure maintains the position of the outer cage 7 and inner mandrel 8, and a de-watering pressure is present in the region below the sealing arrangement 5. The sealing arrangement 5 may for example be an expandable packer element.

Figure 4:
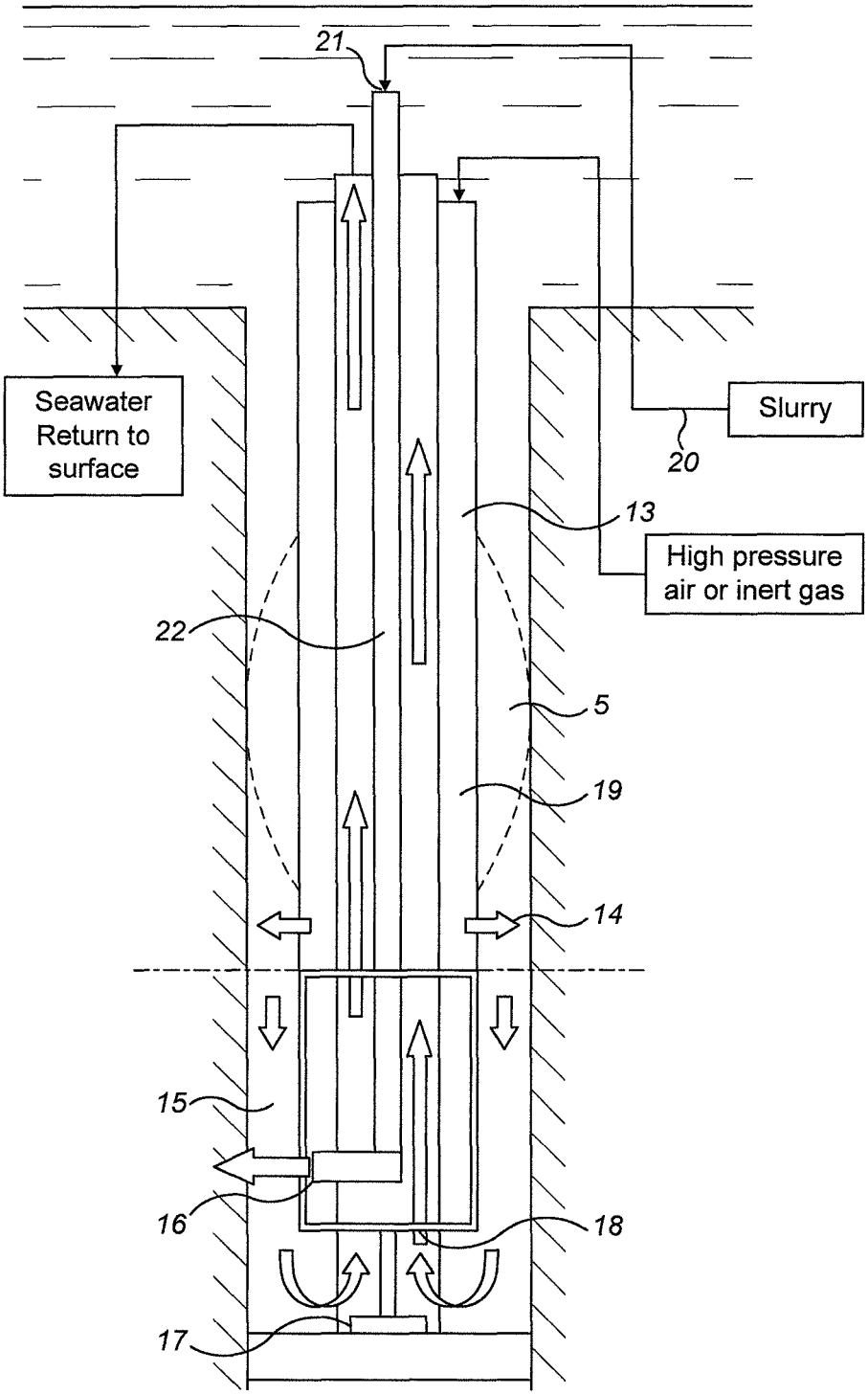
FIG. 4 is a schematic view of a lower part of the downhole cutting tool of FIG. 1.

Once the locking arrangement is activated the tool is secured within the casing against movement either vertically or rotationally and the severing operation can begin.

Where a sealing arrangement is provided within the tool as shown for example in FIG. 4, this isolates the lower portion of the tool beneath the mechanical locking arrangement and allows a high pressure air or inert gas such as nitrogen to be pumped through the tool from a topside compressor (not shown). The high pressure air or inert gas travels through a sealed passage 13 within the tool and exits the passage via one or more ducts 14 in the body of the tool below the locking and sealing arrangements. The pressure within the isolated region of the wellbore below the sealing device is controlled to be above the hydrostatic pressure of the surrounding sea water.

The cutting jet system at the bottom (in use) of the tool portion 6 comprises a rotating assembly 15 which houses a jetting nozzle 16. A proximity sensor 17 is provided at the lower end (in use) of the cutting tool. As the pressure is increased in the isolated area below the sealing arrangement 5, wellbore fluids such as water based muds or seawater in the isolated area are forced through an aperture 18 in the lower end of the tool which leads into a return line 19 in the tool which is connected via a hose or line to the surface where it is dispersed to the surrounding sea water. When the proximity sensor 17 in the cutting tool detects that the fluids such as water in the isolated area have been replaced by the high pressure air or inert gas, the cutting jet is activated.

An abrasive, fluid or water based slurry is pumped down to the nozzle 16 via an umbilical 20 from the surface. The umbilical is connected to a port 21 at the top end of the tool (in use) which leads into a duct 22 through the tool with the nozzle 16 provided at the lower end of the duct. The slurry is forced through the duct and out of the nozzle and is directed perpendicularly towards the well bore forcing it out towards the well casings and conductors allowing these to be severed.

During the cutting operation, the high pressure air or inert gas continues to be pumped through the tool and the resulting positive pressure surrounding the nozzle 16 of the cutting tool prevents any external seawater from flowing back into the well once the jet has penetrated and severed all of the casing strings even when the final casing string is severed and the wellbore is blown out to the surrounding sea bed.

The rotating assembly is controlled by the operator through one or more rotations to sever each of the concentric internal casing and external conductor/casing strings to be severed at that position.

Once all of the casing strings are severed, the abrasive water jet system is shut down and the isolated area below the sealing arrangement is depressurised. The sealing arrangement 5 is disengaged and the mechanical locking mechanism 4 is deactivated and the tool is recovered from the well bore.

Although in the above embodiments the piston 13 actuates the inner mandrel 8 to move when setting the locking mechanism, in alternative embodiments the piston may actuate the cage 7 to move. In essence, the inner mandrel 8 and cage 7 must move relative to one another to cause the locking mechanism 4 to move between a locked and an unlocked position, and therefore the means by which this is achieved other than by use of a piston 13 and/or moving the inner mandrel 8 will be apparent to the person skilled in the art.

However, preferably and as described above, the downhole cutting tool is lowered into the well casing 3 and the lock mechanism 4 is actuated with the cage 7 effectively static whilst the mandrel 8 is dynamic, that is lifted upwards by the piston 13. The advantage of this arrangement is that should failure of the actuation system (for example, the piston 13 or an alternative, such as a hose) occur, with no significant pressure below the tool portion 6, the downhole cutting tool 1 will unlock and remain recoverable from the well.

In addition, a system is provided that should there be a failure of the lock supply pressure, the dewatering pressure supply to below the sealing arrangement 5 will be closed off automatically, such that the pressure from below the tool portion 6 may be bled to atmosphere. This results in there being no further build up of pressure that may result in the downhole cutting tool 1 from being ejected from the well casing 3, and ensures that the downhole cutting tool 1 remains recoverable from a well when there is no pressure differential across the sealing arrangement 5.

It will be appreciated that the present invention provides a cutting tool which provides a locking force against the inner casing wall to prevent axial movement of the tool away from the deployment depth as can be experienced with inflatable packers. The locking force also prevents rotational movement of the tool with in the casing. The mechanical locking arrangement also assists in centralising the tool within the wellbore thereby avoiding damage both to the tool during use but also irregular or ineffective cutting operations. The number of rows of tapered recesses and the number of balls of the tool may be varied as required.

The cutting tool of the present invention may be particularly useful in decommissioning operations where a well casing is to be severed from internally of the casing, but may also be useful in operations where other structures such as platform legs are severed. In this case the tool would be deployed internally of the platform leg and locked in position at the required height for the cutting operation to be carried out.

It is also envisaged that the locking arrangement may provide an additional function in assisting recovery of severed casing sections back to surface. In this case after a section of casing has been cut, the tool may be pulled back out of the well with the locking arrangement still engaged thereby pulling the section of casing above the cut line out of the well with the tool.

These and other advantages of the present invention will be apparent from the appended claims.

The invention claimed is:

1. A jetting cutting tool adapted to be deployed into a well casing for cutting through casing strings, the tool comprising a nozzle for directing a jet of an abrasive slurry at the wall of a well casing to sever the well casing and a mechanical locking arrangement provided above the nozzle, said locking arrangement comprising radially expandable means selectively engageable with an inner wall of the well casing within which the tool is deployed, to prevent axial and/or rotational movement of the tool in the well during cutting operations;

wherein the mechanical locking arrangement comprises an outer cylindrical cage and an inner mandrel, the inner mandrel being moveable axially relative to the cage between a locked and an unlocked position;

wherein the inner mandrel has a profiled outer surface, the outer surface of the inner mandrel has a plurality of tapered recesses, and wherein a ball is provided within each of the tapered recesses in the inner mandrel, and wherein the outer wall of the cage is provided with a plurality of apertures such that a ball is held within a recess by the cage.

2. The cutting tool of claim 1, wherein the diameter of the balls is greater than the diameter of the apertures.

3. The cutting tool of claim 1, wherein the balls are moveable between being retained within the recesses and protruding through the apertures of the cage.

4. The cutting tool of claim 3, wherein when the inner mandrel is in a locked position, the locking arrangement is radially expanded such that the balls protrude through but are retained within the apertures of the cage and engage with the inner wall of the casing.

5. The cutting tool of claim 3, wherein when the tool is in a vertical position, the weight of the inner mandrel and associated tool mass defaults the locking arrangement into the unlocked position, such that the balls are retained within the recesses.

6. The cutting tool of claim 1, further comprising a sealing arrangement.

7. The cutting tool of claim 1, wherein the locking arrangement is combined with a sealing arrangement.

8. A method of cutting through well casing in a casing string comprising the steps of deploying a jetting cutting tool into the well casing to the required depth at which the cut is to be made, the jetting tool including a nozzle for directing a jet of an abrasive slurry at the wall of a well casing to sever the well casing and a mechanical locking arrangement provided above the nozzle, said locking arrangement comprising radially expandable means selectively engageable with an inner wall of the well casing within which the tool is deployed, to prevent axial or rotational movement of the tool in the well during cutting operations, the mechanical locking arrangement comprises an outer cylindrical cage and an inner mandrel, the inner mandrel being moveable axially relative to the cage between a locked and an unlocked position, the inner mandrel having a profiled outer surface with a plurality of tapered recesses, and wherein a ball is provided within each of the tapered recesses in the inner mandrel, and wherein the outer wall of the cage is provided with a plurality of apertures such that a ball is held within a recess by the cage;

locking the tool against the inner wall of the well casing above a nozzle of the tool to prevent axial or rotational movement of the tool during the cutting operation, pumping an abrasive slurry through the jetting tool and rotating the nozzle of the jetting tool to force a high powered jet of slurry against the inner wall of the well casing such that the well casing is severed.

9. The method of claim 8 wherein the tool is locked against the inner wall of the well casing by selectively radially expanding a portion of the tool above the nozzle against the inner wall of the well casing.

10. The method of claim 8 further including the step of isolating a portion of the wellbore between the expanding portion of the tool and the nozzle.

11. The method of claim 10, further comprising the step of recovering one or more severed casing sections out of the well.

12. The method of claim 8, further comprising the step of recovering one or more severed casing sections out of the well.

13. A method of cutting through well casing in a casing string comprising the steps of deploying a letting cutting tool into the well casing to the required depth at which the cut is to be made, locking the tool against the inner wall of the well casing above a nozzle of the tool to prevent axial or rotational movement of the tool during the cutting operation, pumping an abrasive slurry through the jetting tool and rotating the nozzle of the jetting tool to force a high powered jet of slurry against the inner wall of the well casing such that the well casing is severed, and isolating a portion of the wellbore between the expanding portion of the tool and the nozzle;

wherein the portion of the wellbore is isolated by pumping high pressure air or an inert gas into the wellbore between a sealing device and the nozzle.

14. The method of claim 13, wherein the jetting tool is activated only when the absence of well fluids in the isolated area surrounding the nozzle is detected.

15. The method of claim 14, further comprising the step of recovering one or more severed casing sections out of the well.

* * * * *